United States Patent [19]

Total

[11] 4,021,293

[45] May 3, 1977

[54] HIGH SPEED LABELING MACHINE

[75] Inventor: Robert V. Total, St. Marys, Pa.

[73] Assignee: Stackpole Machinery Company, Johnsonburg, Pa.

[22] Filed: Nov. 7, 1975

[21] Appl. No.: 629,908

[52] U.S. Cl. ..... 156/568; 156/571; 156/DIG. 31; 271/93; 271/95

[51] Int. Cl.[2] ..... B65C 9/14; B65H 3/12; B65H 3/40

[58] Field of Search ... 156/571, 568, 567, DIG. 31, 156/DIG. 42; 271/93, 95, 120

[56] References Cited

UNITED STATES PATENTS

| | | | |
|---|---|---|---|
| 2,593,181 | 4/1952 | Pritchard | 271/95 X |
| 3,450,591 | 6/1969 | Zodrow | 156/571 |
| 3,682,470 | 8/1972 | Takagi et al. | 271/95 |
| 3,720,409 | 3/1973 | Kubo et al. | 271/95 |
| 3,928,120 | 12/1975 | Zodrow | 156/568 |

*Primary Examiner*—Charles E. Van Horn
*Assistant Examiner*—M. G. Wityshyn
*Attorney, Agent, or Firm*—Brown, Murray, Flick & Peckham

[57] ABSTRACT

A drum continuously rotating on a vertical axis carries at least two pairs of label transfer members spaced circumferentially around its axis and rotatably connected to the drum on vertical axes. One of the transfer members in each pair is a pick-up member and the other a delivery member, with the pick-up members alternating with the delivery members. The pick-up members are continuously rotated on their axes in one direction while the delivery members are rotated in the opposite direction at the same speed. Each of the transfer members has a label-contact surface provided with a vertical row of air inlets, the contact surface of each pick-up member facing away from the axis of the drum when that member is in pick-up position at the label magazine, at which time suction is applied to the air inlets to withdraw a label from the magazine. The suction is subsequently released while suction is applied to the air inlets in the delivery member of the same pair when their contact faces are directly opposed to each other, whereby to transfer the label from the pick-up member to the delivery member. The contact surface of the delivery member faces away from the axis of the drum when that member is in delivery position beside the label-applying apparatus. The suction at the delivery member is released after the label has been delivered to the label-applying apparatus. The rotations of the drum and delivery members combine to move the contact surface of the delivery member that is in delivery position forward at the same speed as the adjoining surface of the label-applying apparatus.

8 Claims, 9 Drawing Figures

HIGH SPEED LABELING MACHINE

There are many patents on labeling machines, in which labels are withdrawn one at a time from a magazine and then transferred to a labeling drum that applies them to containers passing the drum on a conveyor. For obvious reasons, it is highly desirable to apply labels as fast as possible, but the faster the application the more difficult it becomes to accurately position the labels on the containers, and in many cases very accurate positioning is required. For example, the bottlers of whiskey and other alcoholic beverages often are very particular about the position of the labels on the bottles, especially in relation to the vertical seam lines on the opposite sides of each bottle, which are caused by the glass molds. At the same time they want high speed labeling, but the faster the labels are removed or picked from a magazine the more chance there is that there will be variations in the areas of the labels engaged by the picking mechanism, and that results in the labels engaging different areas of the bottles. As a solution to the problem, it has already been proposed that labels be picked from a magazine at one speed and applied to containers at a greater speed, but the machines for doing this have involved complicated change-speed mechanism that are undesirable. See U.S. Pat. No. 3,537,934.

It is an object of this invention to provide a relatively simple labeling machine in which there is apparatus for picking labels from a magazine at one speed and then transferring them to more rapidly moving label-applying apparatus at a higher speed, whereby the labels are picked slowly and applied rapidly. Another object is to provide such a machine in which the label-picking apparatus includes label-engaging members, all of which rotate continuously at a uniform speed while traveling in a circular path continuously at a uniform speed.

The preferred embodiment of the invention is illustrated in the accompanying drawings, in which FIG. 1 is a schematic plan view;

Figure 1:
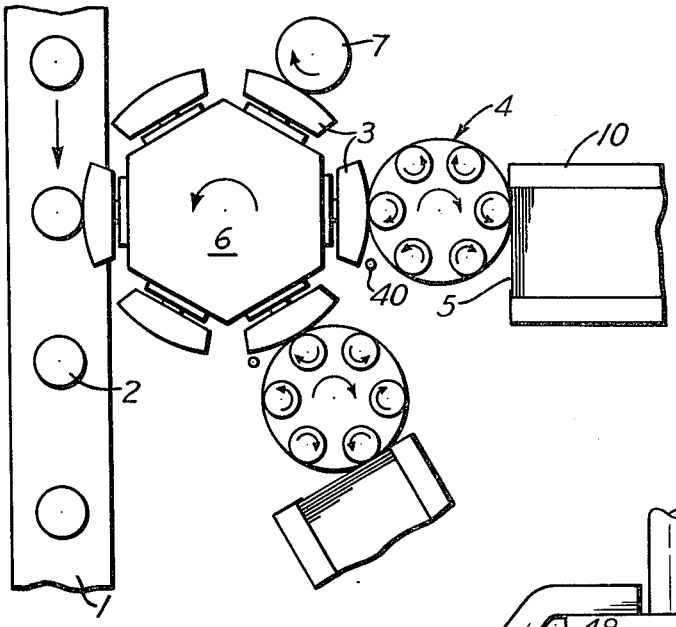
Figure 2:
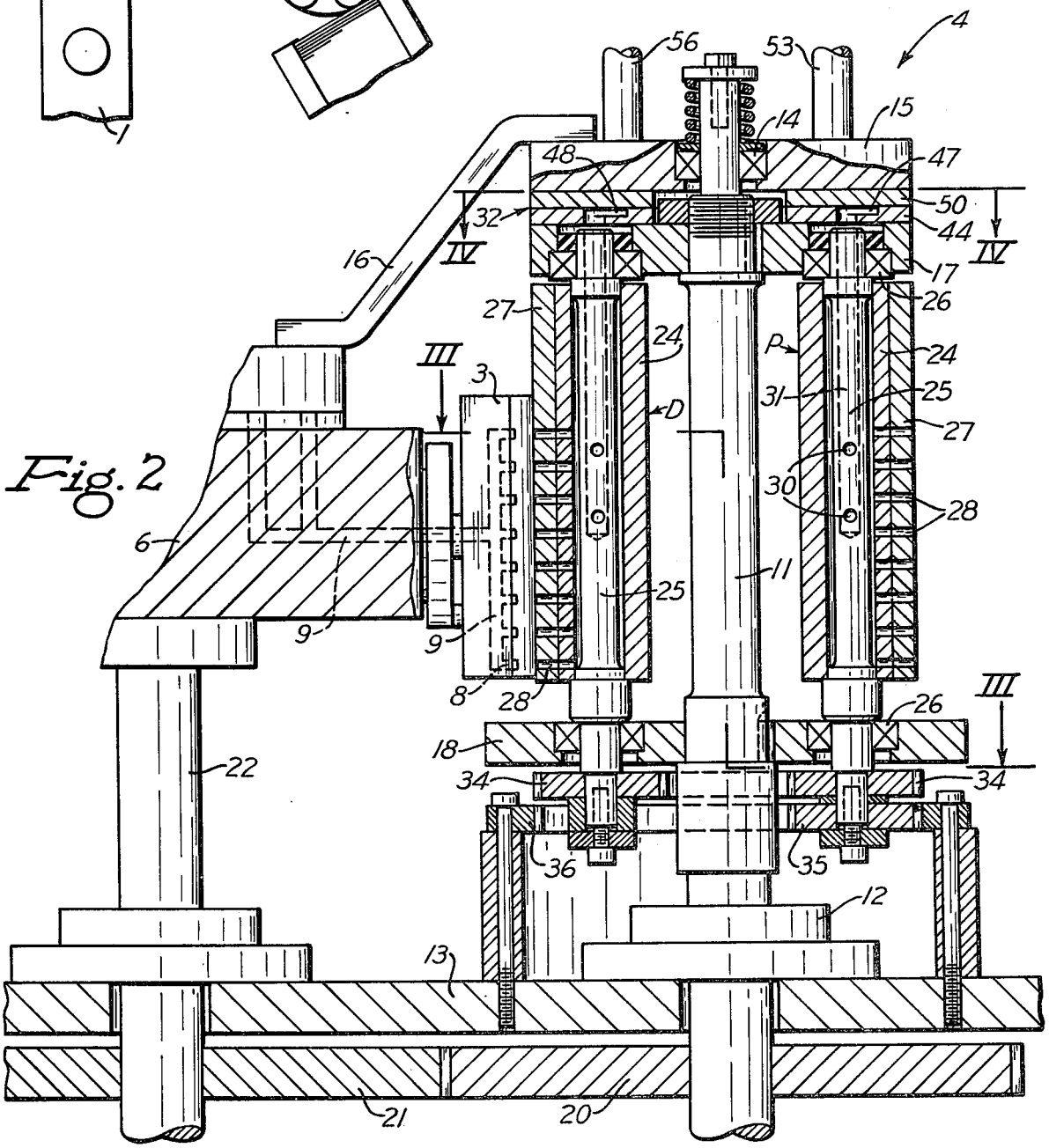
FIG. 2 is an enlarged central vertical section of one of the label picker drums, with a fragment of the labeling drum beside it.

Referring to FIG. 1 of the drawings, beside a conveyor 1, by which uniformly spaced bottles 2 or other containers are carried along at high speed, there is label-applying apparatus that includes vacuum pads 3 that transfers labels 5 from a label-picking drum 4 to the bottles. The pads move forward beside the bottles at the same speed as the conveyor and for this purpose they could be connected to an endless chain, but preferably they are part of a labeling drum 6 that rotates on a vertical axis beside the conveyor. The vacuum pads are spaced uniformly around this drum and each has a convex outer contact surface for receiving labels and then applying them to the bottles on the conveyor after carrying them past a glue roll 7 that applies glue to the labels so that they will adhere to the bottles. The convex contact surface of each vacuum pad is provided near its leading end with a vertical row of air inlets 8 as shown in FIGS. 2 and 5, the inner ends of which are connected by passages 9 extending through the pad and into the drum in the usual way to valve means (not shown) that periodically connect the inlets with a suitable source of vacuum.

Figure 3:
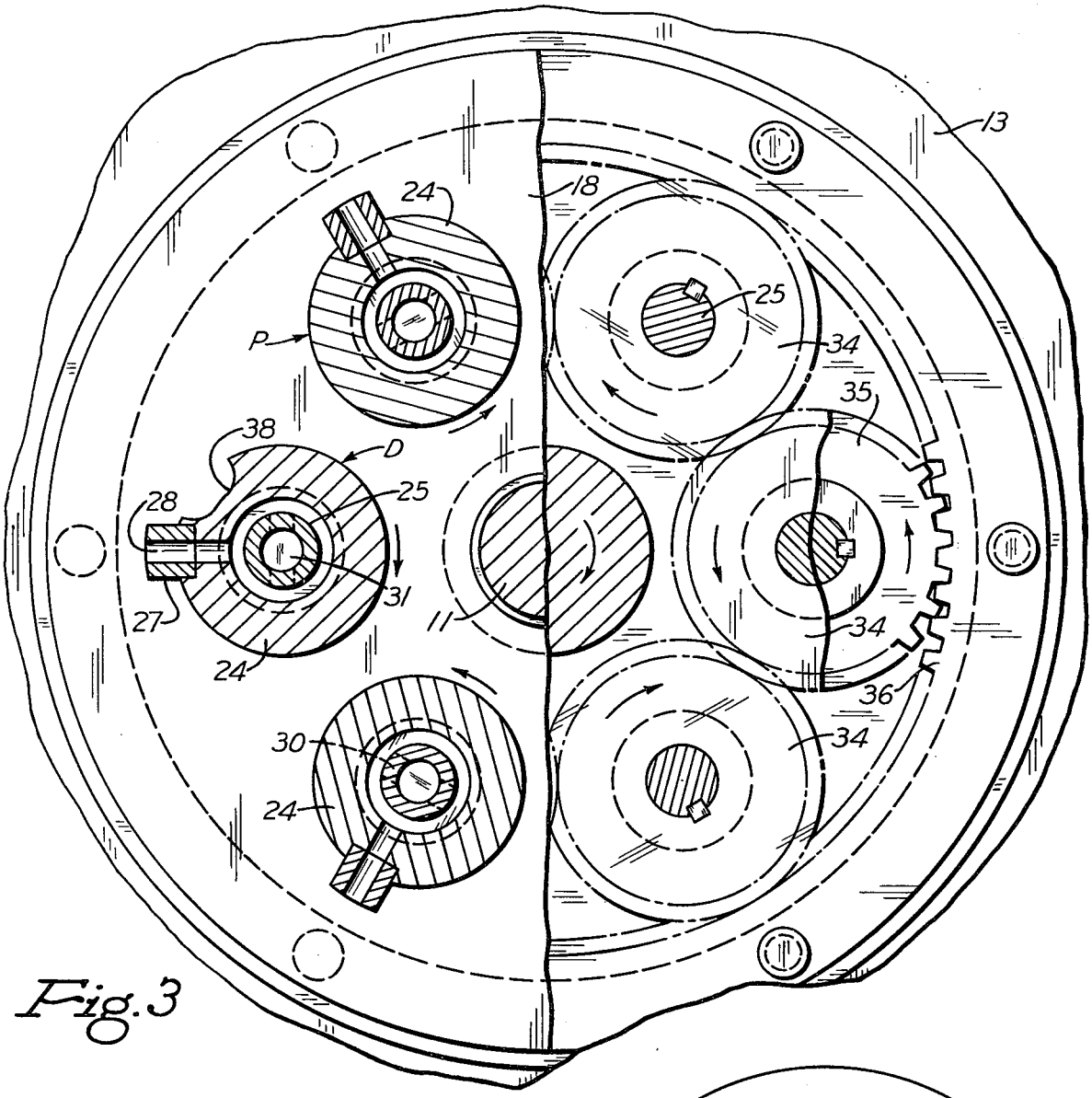
FIGS. 3 and 4 are further enlarged horizontal sections taken on the lines III—III and IV—IV, respectively, of FIG. 2.

Beside the labeling drum there is the drum 4 for picking labels from a magazine 10 and delivering them to the labeling drum. As shown in FIGS. 2 and 3, this picker drum includes a rotor rotatable on a vertical axis. The rotor has a much smaller diameter than the labeling drum. The rotor shaft 11 is supported at its lower end in a bearing 12 secured to a support 13, and the upper end of the shaft is mounted in a bearing 14 in a top plate 15 that is rigidly connected by an arm 16 to the stationary top plate of the labeling drum 6. Keyed on rotor shaft 11 a short distance below the top plate 15 is the circular upper plate 17 of the rotor, the circular lower plate 18 of the rotor being keyed on the lower portion of the shaft. The lower end of the shaft is connected by a gear 20 to a gear 21 on the drive shaft 22 of the labeling drum, and the two shafts are driven continuously at constant speed by any suitable driving means operated by an electric motor.

Rotatably mounted between the upper and lower rotor plates are two or more pairs of equally spaced transfer members, three being illustrated. Each transfer member preferably is formed from a vertical cylinder 24 encircling a vertical shaft 25 rotatably mounted in bearings 26 in the rotor plates. The upper and lower ends of the cylinders are secured to the shafts, but the intermediate portions of the cylinders are spaced from the shafts. Each cylinder is provided in its side with a vertical slot, in which a vertical contact bar 27 is secured by screws or the like. The exposed outer surface of the bar that faces away from the cylinder is curved transversely as shown in FIG. 3, and forms a contact surface for engaging labels. The bar and the cylinder wall behind it are provided with a vertical row of radial air inlets 28. The inner ends of these inlets open into the space around the central shaft 25. The shaft is provided with one or more radial openings 30 that communicate with an axial passage 31 extending from them up through the shaft to a valve 32 located between the plates 15 and 17. As will be explained later, this valve periodically connects the air inlets 28 with a source of suction.

Figure 5:
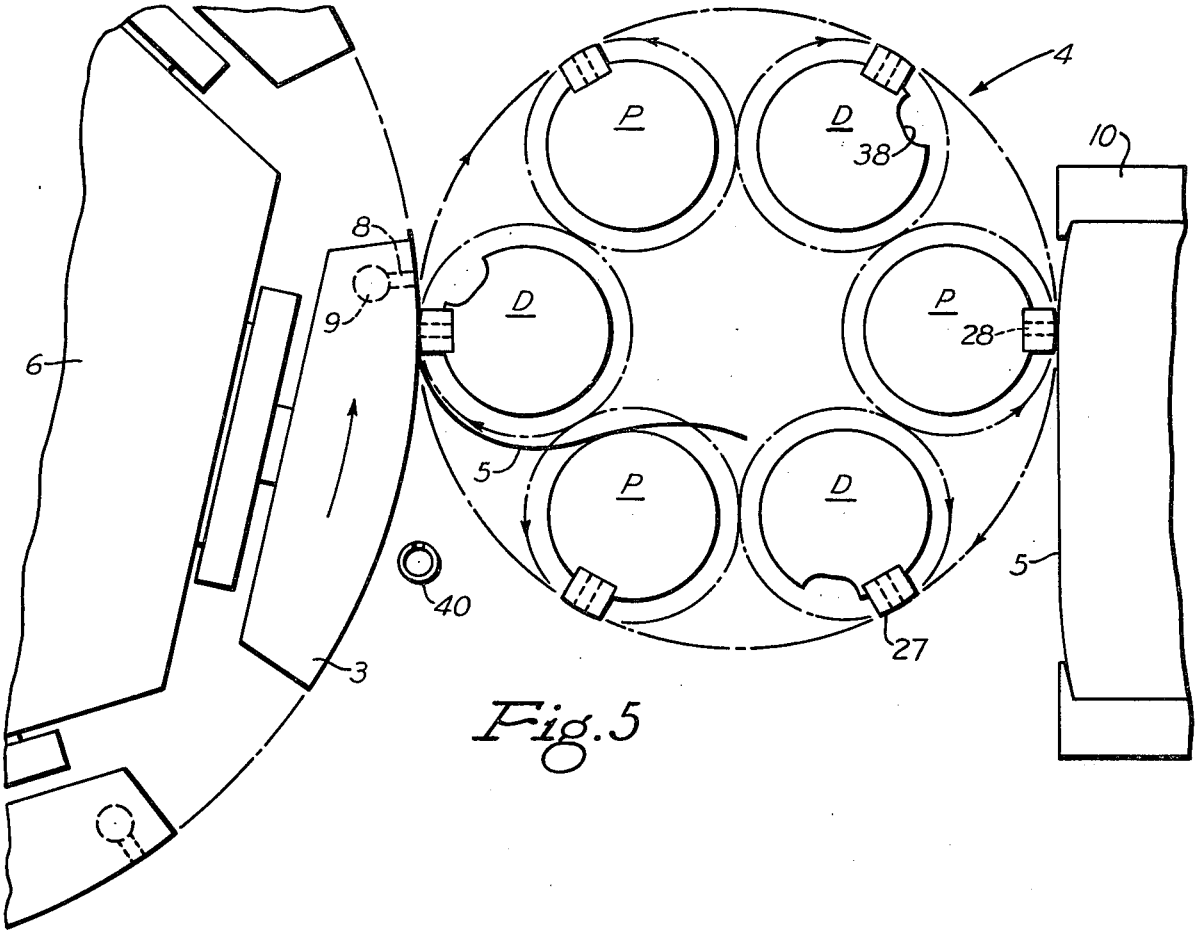
FIGS. 5 to 9 are schematic plan views illustrating the different positions of a label as it is withdrawn from a magazine and carried around to the labeling drum.

With the arrangement shown in the drawings, gears 20 and 21 are the same size so that both drum shafts will rotate at the same speed, but the circle described by the curved surfaces of contact bars 27 when they are in the position shown in FIG. 5 is only half the diameter of the circle described by the contact faces of vacuum pads 3. Consequently, the peripheral speed of the labeling drum is twice the peripheral speed of the picker drum. Other speed ratios could be chosen, but a 2 to 1 ratio is suitable. It permits labels to be taken from the magazine at half the speed at which they are applied to containers by the labeling drum.

In each pair of transfer members, the rear one in the direction of rotation of the picker drum is a pick-up member P and the forward one is a delivery member D, and these alternate around the drum. All of the transfer members are rotated at the same speed by gears 34 mounted on the lower ends of their shafts 25 beneath the lower rotor plate. Since the gears mesh with one another around the rotor, the pick-up members will rotate in one direction and the delivery members in the opposite direction. To rotate the transfer members, a drive gear 35 is secured to the lower end of one of the pick-up member shafts and meshes with an encircling ring gear 36 that is rigidly mounted on support 13. Therefore, as the picker drum rotates in a clockwise direction, drive gear 35 is compelled to turn in the opposite direction as it rolls around the ring gear, and this causes the circle of gears 34 above it to be rotated, whereby all of the pick-up members P rotate counterclockwise on their axes, and all of the delivery members D rotate clockwise. The diameter of the circular path in which the curved contact surface of each contact bar 27 travels is the same as the pitch diameter of the underlying gear 34, and the contact surface forms an arc of that path.

Figure 8:
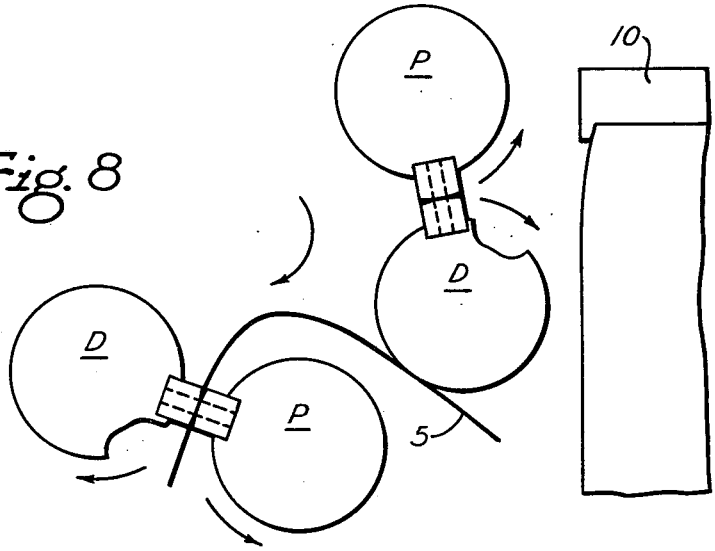

The transfer members are so oriented relative to the rest of the apparatus that when the contact bar of a delivery member D is directly between the axes of the two drums, as shown in FIG. 5, with its contact surface facing the axis of the labeling drum, the contact surface of the diametrically opposite pick-up member P will face away from the axis of the picker drum and engage the row of labels in the magazine 10. At this particular moment the contact surfaces of all of the rest of the transfer members likewise face away from the axis of the pick-up drum, and form areas of a circle concentric with the picker drum axis. As the picker drum revolves, each transfer member makes three complete revolutions on its own axis as the drum makes a single revolution. Since the transfer members in each pair revolve in opposite directions, there is a point in their rotation where their contact surfaces are directly opposed to each other. This occurs, as shown in FIG. 8, when a transfer member has turned on its axis 240° from a position in which its contact surface faced away from the axis of the picker drum.

OPERATION

Figure 6:
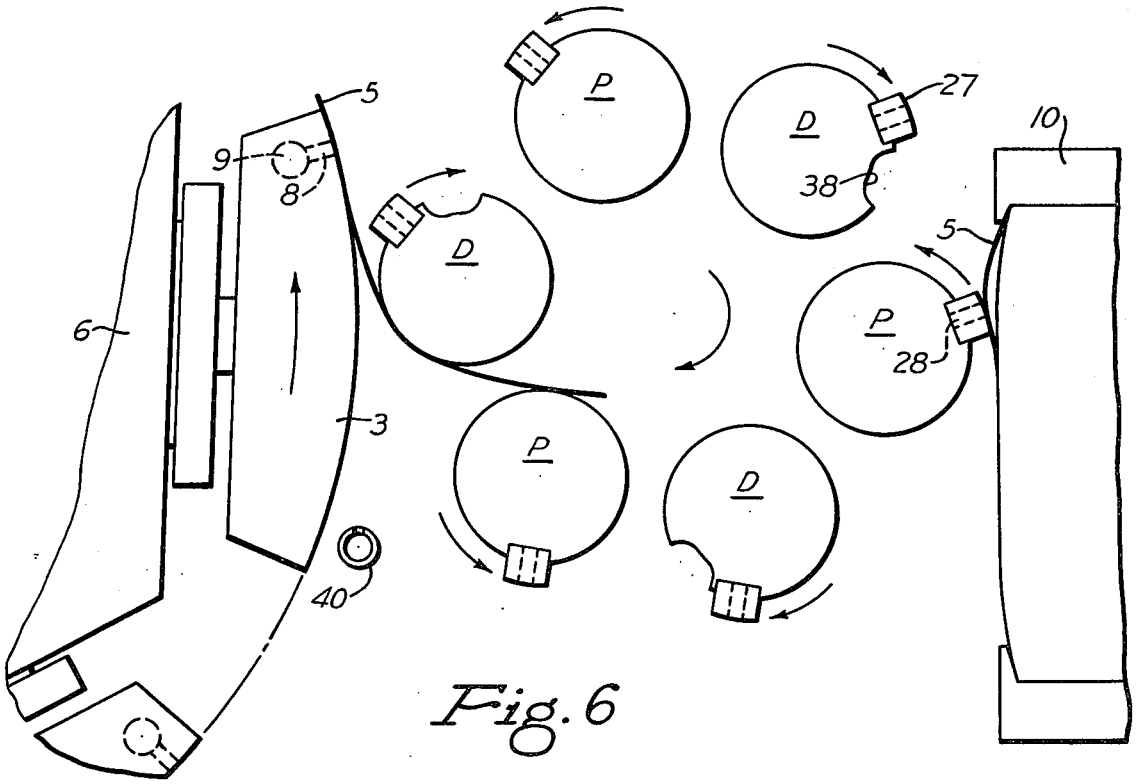
Figure 7:
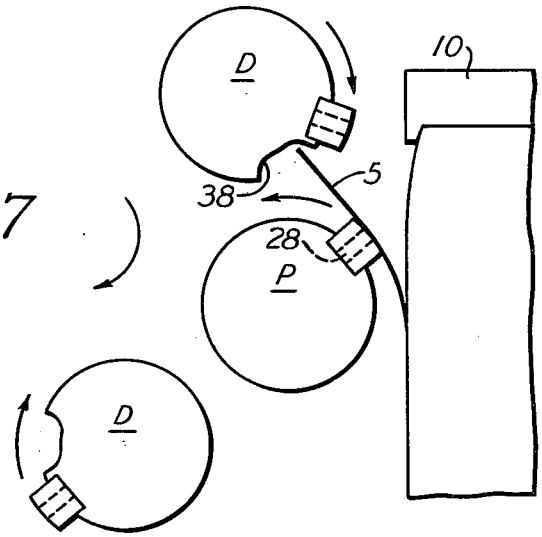

In operation, when the trailing edge of the contact bar 27 of a pick-up member P approaches the label magazine (the trailing edge being the edge trailing in the direction of rotation of the picker drum), the trailing edge first engages or nearly engages the end label in the magazine and then as the pick-up member continues to be carried forward by the drum, the contact bar rocks forward, in effect, on the label without moving forward across it. As the axis of the same pick-up member comes into line with a line passing through the axes of both drums, as shown in FIG. 5, vacuum is applied to the air inlets 28 in the contact bar to draw a label against its curved contact surface. Further advance of the pick-up member causes the contact bar to rock forward on its leading edge, as shown in FIG. 6, which results in the adjacent end of the label being pulled out of the magazine and swung toward the following delivery member D by the counterclockwise rotating pick-up member. If the length of the label is such that its freed end would catch on the delivery member, the side of that member can be provided with a vertical groove 38 to permit the end of the label to move past the delivery member without touching it, as shown in FIG. 7.

Figure 9:
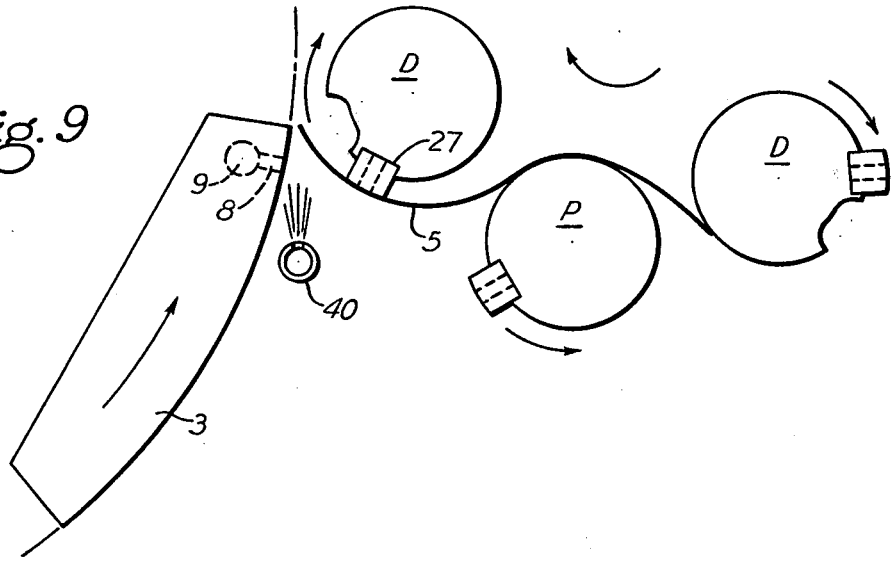

Continued forward travel and simultaneous rotation of the pick-up member will swing the free end of the label backwardly around that member as the delivery member ahead of it rotates clockwise. When the contact bars on this pair of transfer members are directly opposite each other, as shown in FIG. 8, vacuum is applied to the air inlets of the delivery member while the vacuum is released from the pick-up member by connecting the inner ends of its air inlets with the atmosphere. This action transfers the label from the pick-up member to the delivery member. Since the latter rotates in the opposite direction, it will pull the adjoining end of the label outwardly toward the labeling drum. As the delivery member approaches closer to the labeling drum, the projecting front end portion of the label will meet a vacuum pad on that drum and in front of the row of air inlets in it, generally aided by a current of air from a perforated tube 40 between the drums as shown in FIG. 9. By the time the contact bar of this delivery member is in line with the axes of both drums, like one of the delivery members shown in FIG. 5, the two opposed label-engaging surfaces will be traveling forward at the same speed, due to the rotation of the delivery member clockwise on its axis and the simultaneous rotation of the picker drum in the same direction at half the peripheral or surface speed of the labeling drum. At this particular moment, suction is applied to the air inlets in the vacuum pad to attach the label to it, and the vaccum to the delivery member is released. This transfers the label from the picker drum to the labeling drum, which now carries it past the glue roll 7 and applies it to a bottle on the conveyor in the usual way.

As further explanation of the operation of the particular example of the invention illustrated, in which the labeling drum and the label magazine are at diametrically opposite sides of the picker drum, the peripheral speed of which is half the peripheral speed of the label drum, there are three pairs of transfer members carried by the picker drum. The effective circumference of the picker drum is half the effective circumference of the labeling drum, as previously mentioned herein. Assuming that the circumference of the picker drum is 18 inches and the circumference of the labeling drum is 36 inches, the effective circumference of each of the three pickup members P will be six inches, which is one-third the circumference of the pickup drum. The same thing is true of each of the three delivery members D. During each revolution of the two drums a point on the circumference of the labeling drum will travel 36 inches while a point on the circumference of the picker drum travels only 18 inches. At the same time, each transfer member will make three complete revolutions for a total circumferential travel of 18 inches. Consequently, for each revolution of the picker drum, its circumferential travel plus the total circumferential travel of a delivery member D in the same direction during that revolution add up to a travel of 36 inches, which is the same as for one revolution of the labeling drum. The result is that while the contact surface of a delivery member is opposed to the contact surface of a vacuum pad 3 on the labeling drum, both surfaces are traveling forward at the same speed.

With only two pairs of transfer members or more than three pairs in the picker drum, a different rpm around their axes would be required in order for the opposed label-engaging surfaces of a delivery member and a vacuum pad to be moving forward at the same speed at the time a label is transferred to the labeling drum.

Figure 4:
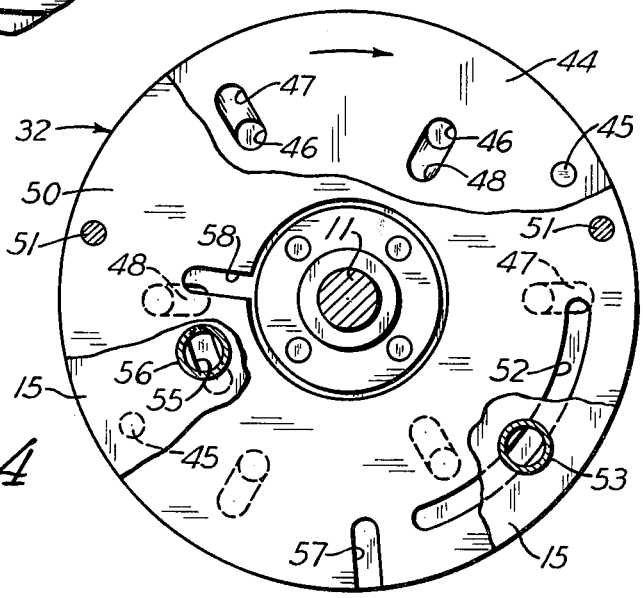

The valve 32 shown in section in FIG. 2 is illustrated in more detail in FIG. 4. This valve is for the purpose of connecting the transfer members 24 first with a source of vacuum and then with the atmosphere so that labels can be transferred from the magazine to the labeling drum 6. The valve includes a flat circular plate 44 that is rigidly mounted on the top plate 17 of the rotor by means of dowel pins 45. This plate is provided with a hole 46 through it directly above the vertical passage 31 in each shaft 25. Extending radially outward from the holes that are above the pickup members P, are short shallow recesses 47 in the upper surface of the plate. Similar recesses 48 extend radially inwardly from the holes that are above the delivery member D.

A stationary upper circular valve plate 50 is seated on the lower valve plate and is secured to the stationary top plate 15 by dowel pins 51. If desired, plates 15 and 50 could be integral and form a single unitary valve plate. The top valve plate 50 is provided with two arcuate slots through it and two radial slots. Thus, a relatively long arcuate slot 52 extends clockwise around the valve for about 110° from an imaginary extension of a straight line connecting the axes of the two drums. Stationary top plate 15 is provided with a vertical opening above this slot, in which the lower end of a tube 53 is mounted that leads to a suitable source of vacuum.

A much shorter arcuate slot 55 through the top plate of the valve is located in a position in which the inner ends of radial recesses 48 will pass beneath it. One end of this slot is only a few degrees away from a line connecting the axes of the two drums, and the slot extends away from that line in a counterclockwise direction. Stationary top plate 15 is provided with an opening through it above this slot for receiving the lower end of a tube 56 that also is connected to the vacuum source.

The top plate 50 of the valve is provided with a radial slot 57, the inner end of which is substantially the same distance as the inner side of long curved slot 52 from the axis of the drum. The outer end of the radial slot opens to the atmosphere. Finally, the top plate of the valve also is provided with a radial slot 58, the outer end of which is substantially the same distance as the outer side of the short arcuate slot 55 from the axis of the drum. The inner end of this radial slot opens to the open center of plate 50, which is connected through bearing 14 with the atmosphere.

It will be seen that the construction of valve 32, as just described, is such that vacuum is applied to the pickup member P approaching the label magazine as its air inlets 28 line up with the axes of the two drums as shown in FIG. 5, the valve then being in the position shown in FIG. 4 with a radial recess 47 communicating with arcuate slot 52. At this same time, the diametrically opposite radial recess 48 in the lower valve plate 44 reaches the overlying radial exhaust slot 58 in the upper plate 50 so that the underlying delivery member D is connected with the atmosphere and releases the label carried by it and which has just been attached to the adjoining vacuum pad 3 of the labeling drum.

As shown in FIG. 1, two identical picker drums can be used with the same labeling drum, in which case two label magazines are used. The picker drums transfer labels from the magazines to alternate vacuum pads 3 on the rotating labeling drum 6. This means that with three pairs of transfer members 24 making up each picker drum 4, there are six vacuum pads on the labeling drum. The bottles on the conveyor are spaced so that there will be a bottle for receiving a label from each successive vacuum pad. If each picker drum transfer 500 labels per minute to the labeling drum, the latter will apply 1,000 labels per minute to bottles on the conveyor.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. Apparatus for picking labels from a magazine at one speed and delivering them to label-applying apparatus traveling at a greater speed, comprising a rotor, means for continously rotating the rotor on a vertical axis, at least two pairs of label transfer members spaced circumferentially around said axis, means rotatably connecting said members to the rotor on vertical axes, one of said members in each pair being a pick-up member and the other a delivery member, the pick-up members alternating with the delivery members, means for continously rotating the pick-up members in one direction and the delivery members in the opposite direction at the same speed, each pick-up member rotating on its axis in a direction opposite to the direction of rotation of the rotor, each of said transfer members having a label-contact surface provided with a vertical row of air passages, and of said contact surfaces facing away from the axis of the rotor when any pick-up member is in pick-up position at a label magazine, means for applying suction to the air inlets in the pick-up member at said pick-up position to withdraw a label from the magazine, means for subsequently releasing said suction and applying suction to the air inlets in the delivery member of the same pair when their contact surfaces are directly opposed to each other to thereby transfer the label from the pick-up member to the delivery member, the contact surface of the delivery member facing away from the axis of the rotor when the delivery member is in delivery position beside traveling label-applying apparatus, and means for releasing the suction at the delivery member after the label has been delivered to the label-applying apparatus, the rotation of said rotor aand delivery members combining to move the contact surface of the delivery member that is in delivery position forward at substantially the same speed as the adjoining surface of the label-applying apparatus.

2. Apparatus according to claim 1, in which said rotor carries said transfer members past the magazine at a speed that is substantially one-half the surface speed of the label-applying apparatus, and said transfer members are rotated on their axes at a peripheral speed substantially the same as said half speed.

3. Apparatus according to claim 2, in which there are three pairs of said transfer members, and each transfer member makes three complete revolutions during each full revolution of said rotor.

4. Apparatus according to claim 1, including label-applying apparatus in the form of a labeling drum provided with circumferentially spaced vacuum pads for receiving labels from said delivery members, and means for rotating the labeling drum continuously at a greater surface speed than said rotor.

5. Apparatus according to claim 4, in which there are twice as many of said vacuum pads as there are of said delivery members, said labeling drum being rotated at a speed that will bring alternate vacuum pads into position to receive labels from said delivery members, and said apparatus including a second rotor and transfer members like said first-mentioned rotor and transfer members for picking labels from a second magazine and delivering them to the vacuum pads that are between said alternate pads, each rotor carrying said transfer members thereon past the label magazine associated therewith at a speed that is substantially one-half the surface speed of the labeling drum, there being three pairs of said transfer members carried by each rotor, and said means for rotating the transfer members causing each transfer member to make three complete revolutions during each full revolution of its supporting rotor.

6. Apparatus according to claim 1, in which said means connecting the transfer members to said rotor include vertical shafts rotatably mounted in the rotor, and said means for rotating the transfer members include gears rigidly mounted on said shafts for driving one another, a driving gear also rigidly mounted on the shaft of one of said transfer members, and a stationary gear coaxial with said rotor, said driving gear meshing with the stationary gear.

7. Apparatus according to claim 6, in which there are three pairs of said tranfer members, and said driving gear causes each transfer member to make three complete revolutions for each 360° of travel of the driving gear around said stationary gear.

8. Apparatus according to claim 1, including label-applying apparatus in the form of a labeling drum provided with circumferentially spaced vacuum pads for receiving labels from said delivery members, means for rotating the labeling drum continuously at the same number of revolutions per minute as said rotor, the label-receiving surfaces of said vacuum pads traveling in a circle having a diameter twice as great as the diameter of the circle in which said contact surfaces of the transfer members are disposed when those contact surfaces are facing away from the axis of the rotor.

* * * * *